United States Patent [19]

Akiba et al.

[11] 3,937,271

[45] Feb. 10, 1976

[54] MEASURING MEANS FOR MEASURING SECONDARY COOLING ZONE ROLLER GAPS IN CONTINUOUS CASTING MACHINE

[75] Inventors: Toyoaki Akiba, Tokyo; Takero Sato, Niihama; Makoto Tokuda; Hiroshi Tomono, both of Wakayama, all of Japan

[73] Assignees: Sumitomo Shipbuilding and Machinery Co. Ltd., Tokyo; Sumitomo Metal Industries Limited, Osaka, both of Japan

[22] Filed: June 10, 1974

[21] Appl. No.: 478,159

[30] Foreign Application Priority Data

June 11, 1973 Japan ..... 48-66129

[52] U.S. Cl. ..... 164/150; 33/182; 72/35; 33/DIG. 5; 164/4

[51] Int. Cl.[2] ..... B22D 1/02

[58] Field of Search ... 164/4, 150, 154, 274, 273 R; 33/182, DIG. 5; 72/35

[56] References Cited

UNITED STATES PATENTS

| | | | |
|---|---|---|---|
| 2,428,234 | 9/1947 | Mapp | 33/DIG. 5 |
| 2,499,665 | 3/1950 | Mestos | 33/DIG. 5 |
| 3,372,731 | 3/1968 | Pauels et al. | 164/274 X |
| 3,646,686 | 3/1972 | Kreiskorte | 33/182 |
| 3,718,019 | 2/1973 | Box et al. | 33/182 X |
| 3,847,206 | 11/1974 | Foyl | 164/274 |

*Primary Examiner*—Ronald J. Shore
*Attorney, Agent, or Firm*—William J. Daniel

[57] ABSTRACT

A measuring means for measuring secondary cooling zone roller gaps in continuous casting machine, wherein measuring means having detecting means for detecting the position of ingot support means are provided on dummy bars transferred through the secondary cooling zone, the ingot support roller gap being measured by the output signal of said detecting means.

Each said detecting means is slidable, and output corresponding to its displacement range is measured and recorded.

9 Claims, 4 Drawing Figures

MEASURING MEANS FOR MEASURING SECONDARY COOLING ZONE ROLLER GAPS IN CONTINUOUS CASTING MACHINE

This invention relates to measuring means for measuring secondary cooling zone roller gaps in continuous casting machine where molten metal is poured into cooling mold from the top-thereof for cooling and solidifying the poured metal from the surface portion thereof and continuously withdrawing the superficially solidified metal from the bottom of the mold.

In this type of casting machine, the secondary cooling zone is usually constituted of ingot supports arranged in two rows facing each other for guiding the primarily cooled ingot between these rows. One ingot support row is arranged at a fixed position along a strand, while the position of the other ingot support row is adjustable in parallel relation to the first row. The gap between these two rows is present to a cavity dimension corresponding to the casting size prior to the operation of the continuous casting machine. However, during the long casting operation error is generated in each region of the cooling zone due to wear or thermal deformation of the ingot supports or damage of the support means, thus resulting in error of the cavity dimension to adversely affect the dimensions and quality of the product. Therefore, it is necessary to check the precision of the gaps so as to hold the cavity dimension of the ingot supports to a predetermined dimension.

In the prior art the measurement of the secondary cooling zone gap is made for each support by the operator using a microgauge or like measuring instrument. However, since the checking has to be made in narrow place with poor foothold, particularly with slippery footing where the ingot supports are rollers, considerable time is required to check the entire secondary cooling zone. Also, this type of checking is not desired from the standpoint of safety and reducing man-hour. Actually, the productivity has been considerably affected by this checking.

An object of the invention is to provide measuring means, which can overcome the above prior-art problems, and in which detecting means for detecting the position of ingot supports are provided in the transferring means transferred through the secondary cooling zone, the ingot support gap being automatically measured from the output signal of said detecting means.

Figure 1:
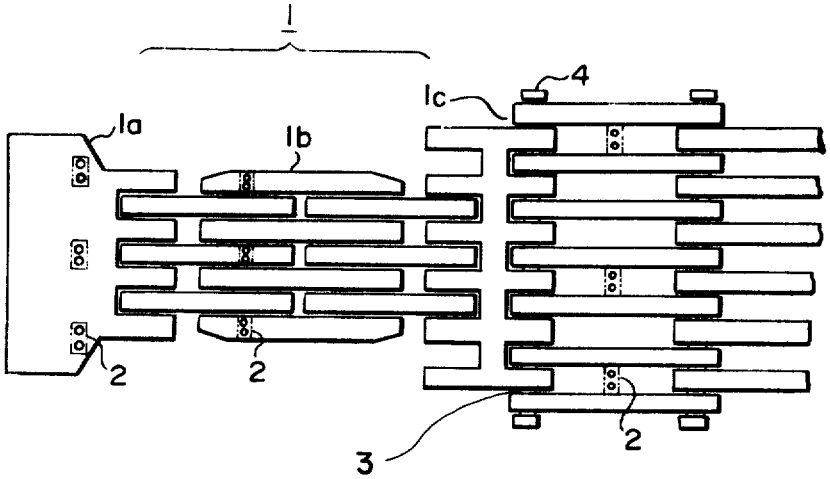
FIG. 1 is a plan view showing a dummy bar head portion incorporating an embodiment of the invention.

Referring to FIG. 1, reference numeral 1 designates a dummy bar, and numeral 2 measuring means including detecting means. As is well known, the dummy bar 1 consists of dummy bar head 1*a*, exclusive dummy bar link 1*b*, common dummy bar link 1*c*., and connecting pins 3 connecting these parts. Each measuring means 2 may be mounted on any of these parts. In order to be able to precisely check the gap dimension, it is desirable to arrange at least three sets of measuring means 2 in a direction at right angles to the longitudinal direction of the dummy bar 1.

Figure 2:
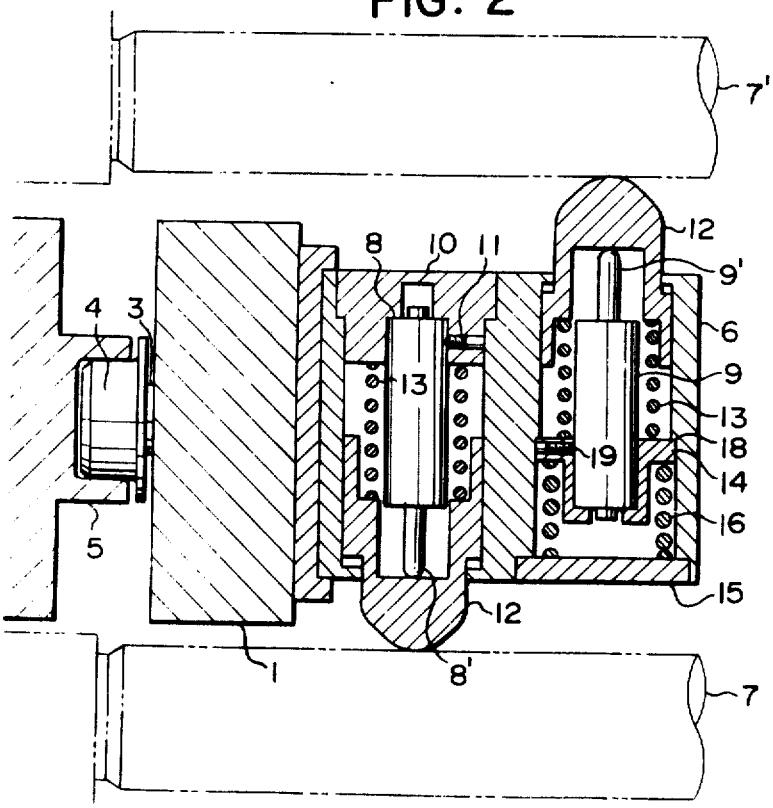
FIG. 2 is a sectional view of a measuring means having two differential transformers serving as detecting means.

As is shown in FIG. 2, the dummy bar link 1 is guided by an associated dummy bar guide 5 provided on a support frame through guide wheels 4 provided on opposite ends of each connecting pin 3. Each measuring means 2 is provided as one block in a case 6. The case 6 accommodates two differential transformers 8 and 9 serving as detecting means for detecting the positions of mutually opposing ingot support rollers 7 and 7′. The differential transformers 8 and 9 have respective springs disposed within them for outwardly urging detecting ends 8′ and 9′ integral with their respective cores. They are mounted or adjusted such that they provide zero output when the detecting ends 8′ and 9′ are in contact if the ingot support rollers 7 and 7′ are held at proper positions. At the position where no billet support roller is present, the output of the differential transformers 8 and 9 swings from the zero point toward the positive side, while at position where the support rollers are present they provide output corresponding to the roller position. One of the differential transformers, namely differential transformer 8, is secured to a mount 10 provided in the case 6 through a cap screw 11. It is provided with a slidable cap 12 fitted on the detecting end 8′ (shown toward the bottom in FIG. 2) for protecting the same end. The tip of the cap 12 is spring biased in forced contact with the ingot support roller 7 by the spring 13 intervening between mount 10 and cap 12. The detecting end 8′ of the differential transformer 8 is urged by a spring provided therein and held in forced contact with the inner end wall of the cap 12 to follow the movement thereof. Thus, the displacement of the cap 12 is indicated as the displacement of the detecting end 8′.

The other differential transformer 9 is directed oppositely with respect to the differential transformer 8. It is secured by a screw 19 to a spring engaging member 14 slidably fitted in the case 6. The spring engaging member 14 is held in forced contact with a shoulder 18 formed in the case 6 by the spring force of a spring 16 intervening between it and a member 15 secured to the case 6. The spring 16 provides a greater spring force than that of the spring 13 in contact with the top side of the spring engaging member 14. In other words, it will not contract within the contraction range of the spring 13, that is, within the detection range of the differential transformer 9, so that the position of the billet support roller 7′ is detected in the state with the spring engaging member 14 integral with the differential transformer 9 held in contact with the shoulder 18.

However, when an external force in excess of the detection range of the spring 13 is experted to the cap 12 such as in case when the dummy bar 1 passes through a billet withdrawal station, the spring 16 is compressed through the spring engaging member 14 to protect the differential transformer 9 from the external force.

The output of the two differential transformers 8 and 9 of the measuring means mounted in the dummy bar 1 in the above way is externally led through leads (not shown) suitably provided along the direction of progress of the dummy bar 1 for display on a well-known recorder such as electromagnetic oscillograph or pen recorder.

Figure 3:
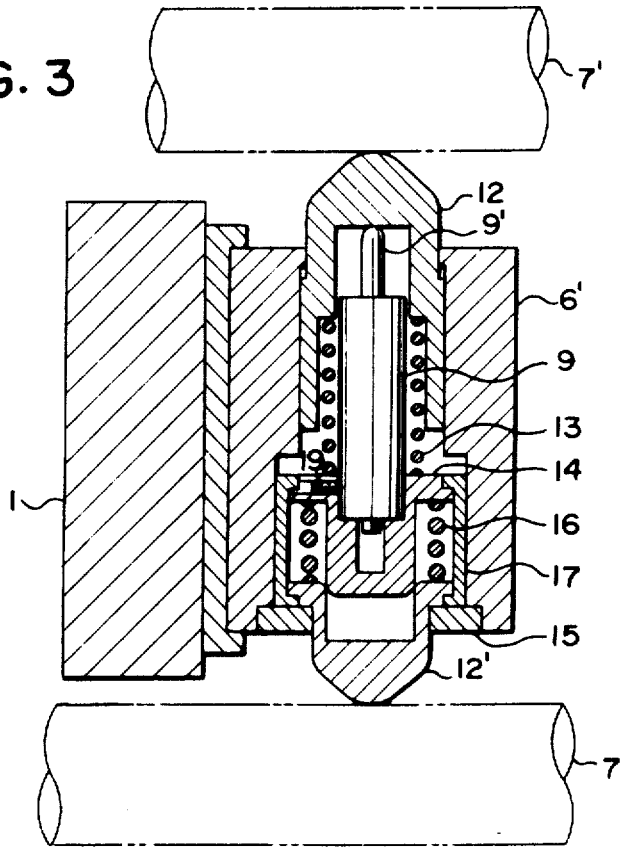
FIG. 3 is a sectional view of a measuring means having a single differential transformer.

FIG. 3 shows another embodiment, which may be applied where it is desired to measure only the gap dimension between the ingot support rollers 7 and 7′. It permits exact measurement of the gap dimension with a single differential transformer 9 which is similar to that in the preceding embodiment. In this embodiment, a cap 12' penetrating retainer 15 secured to the case is provided below the differential transformer 9, and spring 16 is provided between spring engaging member 14 and cap 12'. The spring engaging member 14, spring 16 and cap 12' are accommodated in a guide bush 17 slidably fitted in the case 6'. With this construction the upper and lower caps 12 and 12' are held in forced contact with the respective ingot support rollers 7 and 7' by the spring force of the spring 13 in contact with the top of the spring engaging member 14. In this embodiment again, external forces in excess of the detection range of the differential transformer 9 can be prevented from affecting the differential transformer similar to the preceding embodiment by the contraction of the spring 16.

To improve the measuring precision of the differential transformer, it is necessary to make as small as possible the difference between the center of core of the differential transformer and the center of coil thereof, that is, make as small as possible the detection range. However, the ingot support roller gap in the secondary cooling zone differs depending upon the size of the billet, and it is not rare that the difference exceeds 100 millimeters. Therefore, the selection of the differential transformer is limited by the measuring range and measuring precision.

Figure 4:
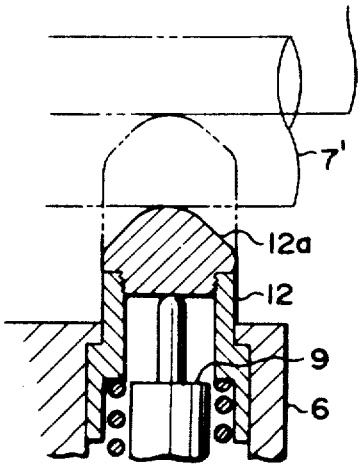
FIG. 4 is a sectional view showing a measuring means having a replaceable cap.

It is possible to obtain desired precision measurment by using measuring means which are prepared for respective range of the billet support roller gap. FIG. 4 shows a more convenient method of obtaining desired precision measurements. Here, caps fitted above and below the differential transformer have respective removable end portions 12*a*. With this construction, precise measurement can be obtained without the need of changing the disposition of the differential transformer. Also, the measuring means for a minimum ingot support roller gap measurement range may be used for other ranges. Further, it is possible to save time of repairing measuring means since worn or damaged caps need only be replaced.

While the above description has concerned with the use of differential transformers for the detecting means, this is by no means limitative, but according to the invention it is also possible to use any other detecting means.

As has been shown with the above construction and function according to the invention it is possible to measure the gap between pair ingot support rollers for ingots of any size reliably, safely and precisely.

What is claimed is:

1. A measuring device for measuring the separation distance between conveying rollers in the secondary cooling zone of continuous casting machines comprising transport means adapted to be guided through said cooling zone between said rollers, said transport means having a maximum dimension parallel to said separation distance which is less than said distance and at least one distance detecting means mounted on said transport means for movement therewith, said distance detecting means including at least one probe projecting beyond the limits of said transport means for engagement with a roller, said probe being displacably supported on said transport means and providing an output signal corresponding in magnitude to the extent of said displacement whereby upon movement of said transport means through said zone, said signal provides an indication of variations in said separation distance along said zone.

2. The measuring device of claim 1 wherein said distance detecting means includes two oppositely projecting probes arranged in close proximity to one another, whereby the combined signals from said two probes indicates the extent of said separation distance at any given point in said zone.

3. The device of claim 2 wherein said two probes are arranged coaxially.

4. The device of claim 1 wherein said transport means carries a plurality of said distance detecting means in laterally spaced and logitudinally staggered relation thereon.

5. The device of claim 1 wherein said distance detecting means is yieldable supported on said transport means to permit bodily retraction where the limit of the tolerable displacement is exceeded.

6. The measuring device of claim 1 wherein said detecting means includes a differential transformer activated in response to displacement of said probe and supplying said output signal.

7. The measuring means according to claim 1, wherein each said detecting means comprises a casing, a spring engaging seat provided within said case, a differential transformer secured to said spring engaging seat and having a core, a detecting rod integral with the core of said differential transformer and outwardly biased by a spring, a slidable cap enclosing and protecting said detecting end, and a spring intervening between said cap and said spring engaging seat.

8. The measuring means according to claim 7, wherein a further spring is provided between a yieldable spring retainer provided at one end of said casing and said spring engaging seat.

9. The measuring means according to claim 7, wherein said cap is replaceable.

* * * * *